United States Patent [19]

Masters

[11] 4,227,272

[45] Oct. 14, 1980

[54] SUPPORTIVE FRAMEWORK FOR A BOAT

[76] Inventor: William E. Masters, P.O. Box 64, Liberty, S.C. 29657

[21] Appl. No.: 5,494

[22] Filed: Jan. 22, 1979

[51] Int. Cl.[3] ..... B63B 3/00; B63B 5/00

[52] U.S. Cl. ..... 9/6 R; 9/1.4; 9/2 F; 114/65 R; 114/63

[58] Field of Search ..... 114/56, 65 R, 63, 78, 114/82, 83–88, 116, 140; 9/1.4, 5, 2 R, 2 C, 2 F, 2 A, 6 R, 6 M, 6 P, 6.5, 11 A

[56] References Cited

U.S. PATENT DOCUMENTS

| | | | |
|---|---|---|---|
| 215,136 | 5/1879 | Knowles | 114/85 |
| 2,472,185 | 6/1949 | Apel | 114/78 |
| 3,076,204 | 2/1963 | Nowak | 9/6 P |
| 3,422,778 | 1/1969 | Halfon | 9/6 P |
| 3,869,743 | 3/1975 | Brown | 9/6 P |

FOREIGN PATENT DOCUMENTS

| | | | |
|---|---|---|---|
| 939645 | 11/1948 | France | 9/6 R |
| 2234181 | 1/1975 | France | 9/6 P |
| 1248351 | 9/1971 | United Kingdom | 9/1.4 |

*Primary Examiner*—Trygve M. Blix
*Assistant Examiner*—D. W. Keen
*Attorney, Agent, or Firm*—Bailey, Dority & Flint

[57] ABSTRACT

A supportive framework is disclosed for a boat having a hull which consists of a flexible plastic skin wherein the bottom frame element of the frame network is tubular and includes a rounded bottom wall which flexes inwardly to absorb stresses upon impact and more widely and uniformly distribute the stresses over the impact area.

6 Claims, 8 Drawing Figures

SUPPORTIVE FRAMEWORK FOR A BOAT

BACKGROUND OF THE INVENTION

With the increasing popularity of white water boating, the provision of water craft which is suitable, safe, and structurally sufficient for this type of recreation is a problem to which considerable attention need be given. In particular, kayak and canoes have been provided which are constructed from a flexible plastic skin to yield upon impact with the water and various obstacles encountered in white water conditions. When using a hull formed from flexible plastic material, such as high-density polyethylene plastic, a supporting framework is necessary to maintain the configuration and structural integrity of the boat under forces of impact with the water and obstacles such as rocks encountered.

Heretofore, frame elements have been provided which have been constructed from solid foam block material in which the foam is semi-resilient to absorb part of the impact.

Tubular framework has also been used which includes hollow frame elements having a rectangular or box cross section such as shown in prior art FIG. 8. The tubular framework members are constructed from flexible plastic, however, due to the cross-sectional configuration of the tubular members, stress is concentrated at the bottom corners of the tubular member resulting in abrading and wearing through of the skin material of the hull along a bottom portion thereof, particularly in the seat areas where weight is concentrated.

SUMMARY OF THE INVENTION

It has been found that a supportive framework can be had according to the invention which distributes stresses encountered upon impact with the water or obstacles therein to reduce wear and abrading of the flexible skin of the hull. In particular, it has been found that a supportive framework accomplishes these and other results which include a tubular bulbous bottom element having a curved bottom wall and converging side walls wherein the bottom wall presents a convexly curved exterior wall surface to the bottom skin material. Molded connection of the bottom frame element with an upper frame element by way of vertical frame elements provides for a predetermined maximum amount of flexing and compressing of the bottom frame element to prevent overflexing and hull disconfiguration due to the collapse of the upper and lower hull sections.

Accordingly, an important object of the present invention is to provide a supportive framework for a boat having a hull constructed of flexible skin material which distributes stresses produced by impact over a wide area to reduce wear and abrading of the skin material.

Another important object of the present invention is to provide a supportive framework for a boat having a hull formed from semi-flexible skin material which may maintain the integrity and configuration of the hull upon extreme impact.

Yet another important object of the present invention is the provision of a supportive framework for a boat having a flexible hull wherein the framework includes a unique elongated bottom frame element having a bulbous configuration which distributes stresses widely and enhances the structural integrity of the supportive framework.

Yet another important object of the present invention is to provide a supportive framework and integral seat design which distributes stresses and minimizes wear and abrading in the seat section wherein greatest concentration of weight occurs.

BRIEF DESCRIPTION OF THE DRAWINGS

The construction designed to carry out the invention will be hereinafter described, together with other features thereof.

The invention will be more readily understood from a reading of the following specification and by reference to the accompanying drawing (s) forming a part thereof, wherein an example of the invention is shown and wherein.

DESCRIPTION OF A PREFERRED EMBODIMENT

It has been found that the invention has particular advantages when used with a kayak type boat which includes a hull A formed as a flexible skin enclosure formed from a crosslink polyethylene material such as Marlex brand polyethylene material manufactured by Phillips Chemical Co. The hull is typically made by utilizing conventional rotational molding machinery or may be made by vacuum molding to provide a continuous enclosed hull having a generally central opening in the upper portion for entry into the kayak.

Figure 1:
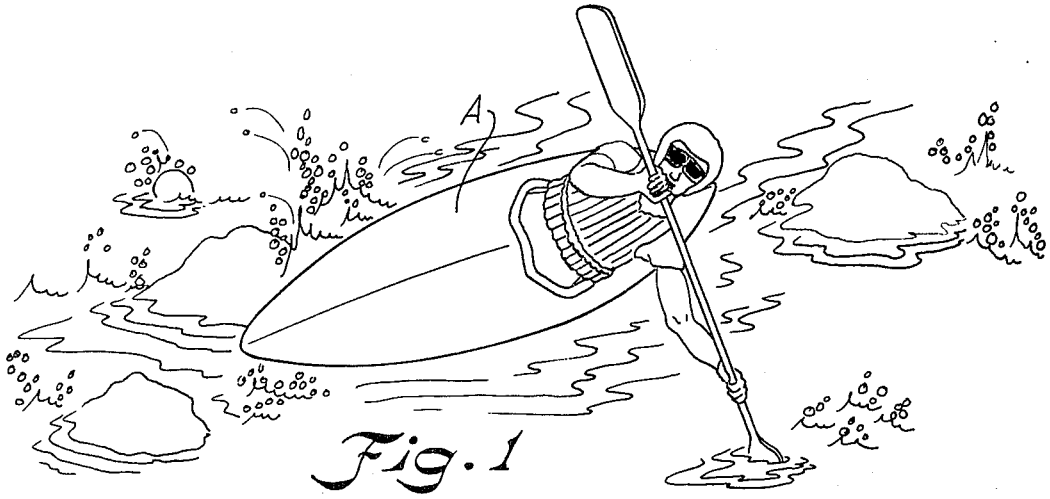
FIG. 1 is a perspective view of a kayak having a hull formed from a flexible skin material.
Figure 2:
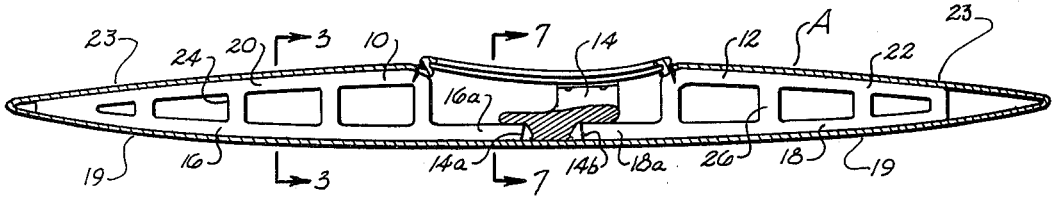
FIG. 2 is a sectional side elevational of the kayak of FIG. 1.

As illustrated in FIG. 2, the kayak includes an internal supporting framework illustrated at B in the form of longitudinally extending frame means which includes a bow framework section 10 and a stern framework section 12 which are functionally joined together under a seat 14 having a pair of bottom cutout sections **14*a* and 14*b*** into which the frameworks are inserted. It is also contemplated that the supporting framework B may be formed as one piece.

Each of the framework sections 10 and 12 include a bottom frame element 16 and 18 carried adjacent a bottom hull portion 19. The bottom frame elements are carried within a slight V-shape crease in the bottom skin material. Upper frame elements 20 and 22 are carried adjacent a top hull portion 23 above each of the respective bottom frame elements 16 and 18 and are supported by a series of vertical frame elements 24 and 26, respectively. Vertical elements 24 and 26 have a diamondshape cross section defining hollow cores and upper frame elements 20 and 22 are likewise tubular or hollow having a generally triangular cross section. The framework sections 10 and 12 are preferably formed as one piece such as by conventional rotational or blow molding or the individual elements thereof may be molded separately and made integral such as by gluing.

Figure 3:
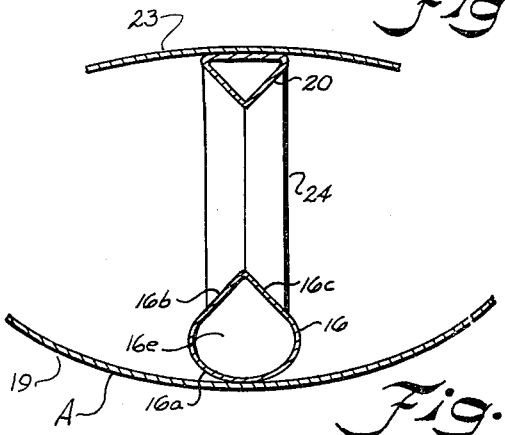
FIG. 3 is a sectional view of a supportive framework constructed according to the invention taken along line 3—3 of FIG. 2.

As illustrated in FIG. 3, the frame elements are tubular having hollow cores and the bottom frame elements 16 and 18 have a unique cross-sectional shape which includes an outwardly bulging rounded bottom wall 16*a* and a pair of upwardly converging walls 16*b* and 16*c* which converge to form an enclosure at an apex portion 16*d* and define a hollow core 16*e*. The exterior of the bottom wall 16*a* defines a convexly curved wall surface which flexes and compresses inwardly upon impact compressing the bottom frame element to distribute the stresses encountered upon impact with the water or obstacles such as rocks encountered in white water conditions.

It has been found that a cross-link polyethylene material such as that described above for the construction of the hull skin is suitable for the molded framework B construction. However, any suitable material having sufficient flexibility to enable the convexly curved bottom element to flex inwardly and the bulbous frame element to be compressed generally and return generally to its original configuration without fatique may be utilized.

Figure 4:
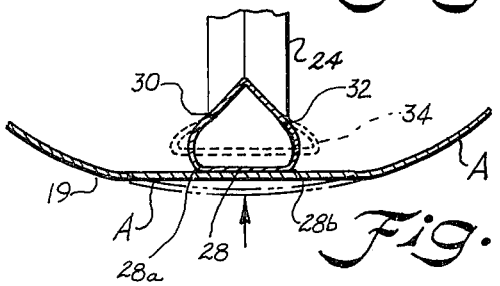
FIG. 4 is a sectional view illustrating the cross-sectional configuration of the bottom frame element of a supportive framework according to the invention upon a bottom impact.
Figure 5:
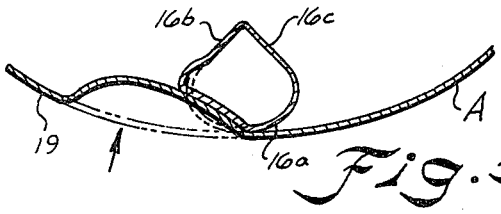
FIG. 5 is a cross-sectional view of a bottom frame element constructed according to the invention in cross-sectional shape thereof when deformed by an impact from the side.

As can be seen in FIG. 4, upon a more or less direct bottom impact, the lower frame element 16 tends to flex or compress and flatten out whereby the stresses are distributed widely over a flattened bottom at 28 while leaving a rounded edge portion at 28*a* and 28*b* which substantially eliminates any wear at these two points. FIG. 5 illustrates the deformation of the lower frame element during a side impact whereby the bottom wall 16*a* and upper wall 16*b* deform slightly as shown in the dotted line to distribute stress avoiding any point contact stresses.

The bottom frame element 16 is designed to deflect only up to a predetermined amount and distribute the stresses as widely as possible while still maintaining the configuration of the hull so as to prevent the collapse of the top and bottom hull portions under normal extreme impact conditions. The predetermined amount of deflection is determined mainly by the intersection of vertical member 24 with the upper walls 16*a* and 16*b* such as at the illustrated points 30 and 32 whereby at a predetermined maximum amount of deflection, the lower frame element would assume a shape as shown by the dotted lines 34 in FIG. 4.

Figure 6:
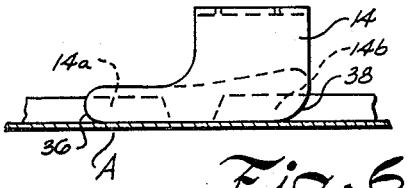
FIG. 6 is a side elevation of a seat secton for a boat which cooperates with a supportive framework according to the invention to reduce wear on skin fabric.
Figure 7:
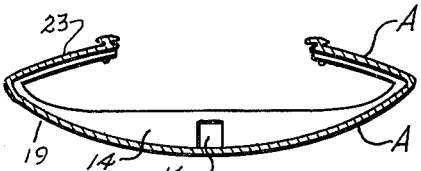
FIG. 7 is a cross-sectional view taken alon line 7–7 of FIG. 2.

FIGS. 6 and 7 illustrate ths seat section 14 as having rounded forward and aft corners at 36 and 38 to eliminate sharp edges and stress concentration at these points during longitudinal flexing of the hull which becomes an important factor in reducing skin wear and abrading at these points where weight is concentrated in the seat section. Seat section 14 is a molded hollow construction which coextends and conforms generally to the cross-sectional configuration of the molded hull A within the interior thereof in the seat section as shown in FIG. 7. Cutouts 14*a* and 14*b* in the seat receive extended ends 16*a* and 18*a* of frame elements 16 and 18 providing hinge joints.

Figure 8:
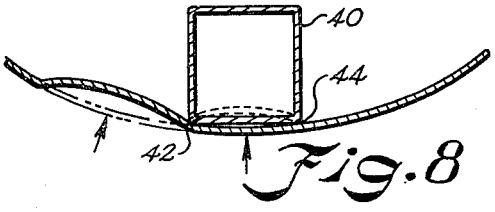
FIG. 8 is a sectional view of a bottom frame element having a tubular box cross-sectional shape according to the prior art.

Thus, it can be seen that an advantageous construction for a supportive framework for a kayak, canoe or the like having a generally flexible hull can be had according to the invention wherein a unique bulbous bottom frame element compresses from a slight amount to a predetermined maximum amount upon impact with the water or obstacles therein affording distribution of the stresses widely over the impact area without overflexing and hull disfiguration due to collapse of the upper and lower sections. The seat section is also construction for elimination of point stress, all of which results in reduced wear and abrading of the skin material of the flexible hull as compared to the prior art such as that shown in FIG. 8 wherein impact of the bottom frame element 40 having a box cross section results in concentration of stress at the rigid corners 42 and 44 and wear and abrading of the skin at these points, usually along longitudinal lines.

While a preferred embodiment of the invention has been described using specific terms, such description is for illustrative purposes only, and it is to be understood that changes and variations may be made without departing from the spirit or scope of the following claims.

What is claimed is:

1. In a boat of the type having a hull constructed from a generally flexible plastic skin material and a supportive framework for supporting and maintaining the configuration of said hull, wherein said framework comprises:

longitudinally extending frame means carried centrally within said hull;

said longitudinally extending frame means including an elongated bulbous bottom frame element which includes an outwardly bulging bottom wall presenting a convexly curved exterior surface to the skin material of a bottom portion of said hull; and said bottom frame element being constructed of a sufficiently flexible material enabling said convexly curved bottom wall to flex inwardly compressing said bottom frame element upon impact of said bottom portion of said hull skin with the water or obstacles therein to distribute and relieve stress concentration on said hull effectively preventing over-flexing of said skin material and hull disfiguration (stress produced thereby).

2. The apparatus of claim 1 wherein said longitudinally extending frame means extends generally vertically between a top and said bottom portions of said hull maintaining the configuration thereof and includes vertical support means connected to said bottom frame element limiting the maximum amount of compression of said bottom frame element preventing disconfiguration of said hull due to collapse of said top and bottom hull portions.

3. The apparatus of claim 1 wherein said longitudinally extending frame means is constructed in separate bow and stern sections functionally joined at a seat section of said hull.

4. A supportive framework for supporting and maintaining the hull configuration of a boat having a hull constructed from a plastic, generally flexible skin material, said framework comprising:

longitudinally extending frame means extending generally centrally within the hull of said boat and extending vertically between top and bottom portions of said hull to maintain the cross-sectional configuration thereof;

said frame means including an elongated bottom frame element having a bulbous cross-sectional configuration defined by an outwardly bulging bottom wall and spaced upper walls extending upwardly from said bottom wall to define an enclosure having a hollow core;

said outwardly bulging bottom wall presenting a convexly curved exterior wall surface to the flexible skin material of said bottom hull portion; and said bulbous bottom frame element being sufficiently flexible enabling said outwardly bulging bottom wall to flex inwardly and compress upon impact with water or obstacles therein to distribute the stresses upon the hull and framework produced upon impact effectively preventing over-flexing of said skin material and hull disfiguration.

5. The apparatus of claim 4 wherein said longitudinally extending frame means includes an upper frame element, support means extending between said upper and bottom frame elements supporting said upper frame element in a superposed position relative to said lower frame element, and said support means connecting said bottom frame element so as to substantially limit the maximum amount said bottom frame element will compress reducing the tendency thereof to over-flex and disfigure said hull configuration due to collapse of said top and bottom hull portions.

6. The apparatus of claim 4 including a seat section receiving a portion of said elongated bottom frame element of said longitudinally extending frame means, said seat section having substantially curved outer edges presenting rounded edge surfaces to said skin material of said hull further reducing concentration of stress on said hull upon impact.

* * * * *